US006655303B1

(12) United States Patent
Finker et al.

(10) Patent No.: US 6,655,303 B1
(45) Date of Patent: Dec. 2, 2003

(54) FURNACE

(75) Inventors: Felix Zalmanovich Finker, St. Petersburg (RU); Igor Borisovich Kubyshkin, St. Petersburg (RU); Yuriy Pavlovich Bakhtinov, St. Petersburg (RU)

(73) Assignee: Polytechenergo, St. Petersburg (RU)

( * ) Notice: Subject to any disclaimer, the term of this patent is extended or adjusted under 35 U.S.C. 154(b) by 0 days.

(21) Appl. No.: 09/913,167

(22) PCT Filed: Apr. 24, 2000

(86) PCT No.: PCT/RU00/00161

§ 371 (c)(1),
(2), (4) Date: Mar. 18, 2002

(87) PCT Pub. No.: WO00/65279

PCT Pub. Date: Nov. 2, 2000

(30) Foreign Application Priority Data

Apr. 23, 1999 (RU) ..... 99109062

(51) Int. Cl.[7] ..... F23D 1/00; F23B 5/00; F23C 9/00

(52) U.S. Cl. ..... 110/210; 110/211; 110/213; 110/266; 110/297; 110/165 R

(58) Field of Search ..... 110/210, 211, 110/213, 266, 265, 264, 263, 261, 260, 267, 341, 347, 165 R

(56) References Cited

U.S. PATENT DOCUMENTS 5,769,008 A * 6/1998 Finker et al. ..... 110/251
6,234,093 B1 * 5/2001 Finker et al. ..... 110/266

FOREIGN PATENT DOCUMENTS

| | | | | |
|---|---|---|---|---|
| FR | 2 415 264 | | 8/1979 | |
| GB | 1 292 606 | | 10/1962 | |
| RU | 2 052 715 | | 1/1996 | |
| RU | WO 97/23750 | * | 7/1997 | ..... F23C/5/24 |

* cited by examiner

*Primary Examiner*—Ira S. Lazarus
*Assistant Examiner*—K. B. Rinehart
(74) *Attorney, Agent, or Firm*—Fay, Sharpe, Fagan, Minnich & McKee, LLP

(57) ABSTRACT

A furnace consists of at least one wall-mounted burner tilted downward for feeding air-fuel mixture and of a prism-shaped ash hopper. Slopes of the walls of lower combustion chamber region define the slotted mouth of ash hopper. The bottom airflow device is located below the ash hopper mouth the wall opposite to the airflow nozzle of the bottom airflow device has a concave form. In accordance with said invention the bottom airflow device spans along the entire width of the ash hopper mouth. The concave wall in its upper region meets the ash hopper mouth and an imaginary plane being a continuation of said concave wall crosses the opposite slopes of the wall of ash hopper in its middle region. The axis of bottom airflow nozzle passes along the lower region of said concave wall and is directed to form a 0-to-45 degree angle between said axis and lower region of said concave wall. The concave wall may be tilted relative to horizon at the angle of 20–45 degrees. The bottom airflow device may comprise of two similar parts symmetrical to the vertical axis of combustion chamber. FIG. 1

24 Claims, 2 Drawing Sheets

FURNACE

FIELD OF INVENTION

The invention relates to the thermal techniques, namely, to furnaces fired with organic fuels. The invention may successfully be applied to firing pulverized fuels.

BACKGROUND OF THE INVENTION

When designing furnaces, much attention is paid to the completeness of fuel combustion what is one of the defining factors for increasing their economic and environmental numbers. It is well known that the increased completeness of fuel combustion may be achieved by thoroughly mixing fuel with air at the increased combustion temperature. However the increased temperature within the combustion region leads to the increased nitrogen oxide emission at the expense of the so-called "thermal" nitrogen oxides resulted from oxidation of nitrogen present in ambient air. Besides, the increased flame temperature causes the slag buildup at the heat absorbing wall tubes and other negative consequences. To reduce temperature in the combustion region a number of techniques is introduced, such as the combustion products recirculation into the furnace, introduction of coarsely pulverized fuel, etc. At present the most effective way is the introduction of vortex furnaces providing maximum combustion temperatures at a relatively low level by increasing residence time of particles within active combustion regions.

Well known is the furnace (SU, A, 483559) consisting of the combustion chamber and the wall-mounted burner used for the air-fuel mixture supply. Tilted walls of the lower combustion chamber region formed the prism-shaped ash hopper with slotted mouth. Below the ash hopper mouth the bottom airflow device is installed. This device is designed, for example, as an air nozzle. At operation of such furnace the air-fuel mixture is fed through the burner and air is fed from below through the slotted mouth. As a result of the interaction of two reversely-directed flows a vortex zone is formed in the lower furnace region whereas the upper furnace region will have a straight-flow zone. Fine particles burn within the straight-flow zone and zones adjacent to the burners where as the middle-sized and coarse particles are separated into the vortex zone. Within the vortex region these particles burn our as a result of repeated circulation. As a size of the coarse particles diminishes these particles are blown out of the vortex zone and burned out within the upper straight-flow flame zone. An intense in-furnace recirculation of air mixture results in a considerable decrease and uniform temperatures within the entire vortex zone. To prevent the combustion of main portion of particles near the burner region and to carefully use the advantages of vortex furnaces, different approaches may be introduced, such as coarsely pulverized fuel with low content of finely pulverized particles, increased burner tilt angles and raised velocity of air mixture fed through the burner to improve the fuel particle separation into the vortex zone. Reduced fuel combustion velocity caused by lowering maximum combustion temperatures and coarsely pulverized fuel are supplemented by increased fuel residence time in the low temperature zone, that is, in the vortex zone. At the same time a considerable part of the vortex zone is a reducing oxygen-deficient region. It enables to lower the nitrogen oxide emission at the expense of oxide reducing.

Industrial tests of a boiler equipped with such burner confirmed considerable temperature and nitrogen oxide reductions in flue gases. However in cases of coarsely pulverized fuel combustion and when coal mills are in unsatisfactory conditions a fuel drop-off into ash hopper may increase. This may be a partial result of the wall tube surface structure when walls of many boilers are panels consisting of vertically mounted tubes between which small slots may be present. These slots may accumulate fuel particles. Fuel particles create so-called "chains". Having reached a critical mass and overcome the reverse airflow resistance, these chains drop into ash hopper. To fire the unburned fuel, the bottom airflow velocity should be increased. This causes higher maintenance costs for the forced and induced draft fans and intensification of the wall tube erosion. Besides, redundantly high velocities of the bottom airflow may distort the optimum vortex process aerodynamics that will result in higher unburned particle content in flue gas. More problems appear if wall tubes are not airtight. This is inherent to almost all older boilers. In this case the unburned particles pass between wall tubes and drop along the thermal insulation plates mounted behind the wall tubes down into ash hopper. In the ash hopper mouth the particles that have moved along that tilted wall where the bottom airflow nozzles are installed enter the flow injected from these nozzles. Some of them return to the active combustion region and the heaviest ones may drop off. It happens because the particles move in the direction counterwise to the bottom airflow direction. The process of returning fuel particles to combustion more effectively occurs when particles move towards the bottom airflow (for example, along a slanted surface). In this case the time required for air to react with a fuel particle and is quite sufficient in order to lower kinetic energy of the latter (the friction of a particle on the surface also contributes) and subsequently to direct it back to the combustion chamber. As for the particles that moved along the opposite slanted wall of ash hopper so they fully drop off. Heat losses resulted from the mechanical combustion incompleteness in the given furnace may considerably exceed the rated numbers. Therefore the economic numbers may be regretfully low. Also well known is the furnace described in the application PCT/RU93/00291. It was introduced to fire coarsely pulverized fuel. The furnace has a combustion chamber with slanted walls in the lower region forming the mouth below which there is the coarse particle treatment chamber equipped with the bottom airflow nozzle in its lower region. The coarse particle treatment chamber is a curved channel with the lower edge of the wall located opposite to the airflow nozzle and below the nozzle axis. The wall equipped with the bottom airflow nozzle has a region located above the opposite one. This region is directed toward the nozzle axis and the opposite wall. The wall opposite to the nozzle is curved and its upper edge is directed along the opposite slanted wall of the vortex chamber. At operation of this furnace the finely pulverized particles burn out near the burner itself and relatively coarse particles fall into the lower region of the vortex zone and enter the bottom airflow fed through the nozzle. The coarsest particles drop through the slotted mouth of ash hopper and, passing through the curved channel, reach the curved wall of the coarse particle treatment chamber. After the fuel particles have entered the curved channel its form provides the change in fuel particle movement in such a way that when caught by the bottom airflow, fuel particles are thrown toward the opposite wall, smashed and pulverized. Relatively fine particles resulted from such pulverization are fed with the airflow into the vortex zone where they burn out. Coarse particles again fall into the lower region and the cycle repeats itself.

Such furnace can be successfully introduced at firing fuel that is coarsely pulverized, highly moist or if a prolonged time for coarse fuel particle treatment is needed. In case when a finely pulverized and relatively dry fuel with low coarse particle content is used the above-mentioned furnace becomes inefficient since the costs for fan devices become unjustifiably high. Energy losses for repeated changes in airflow direction (including the cases of impacts on the opposite wall) are the main cause. In addition, if the fuels being used tend to form the slag buildup the presence of a long curved channel with relatively low cross-sections (necessary for the effective operation of the above-mentioned furnace) below the ash hopper mouth may cause some problems in operation of the boiler. These problems will occur as a result of frequent filling of the curved channel with coarse slag lumps formed at the adjacent walls. This may lead to the operation faults of the furnace or the entire boiler.

DISCLOSURE OF THE INVENTION

The base of the given invention was the task to build a furnace employing a bottom airflow device that provides the fuel particle return into the vortex zone with the purpose of compete combustion and lowering the slag blockage danger of the bottom airflow device with simultaneous increase of economic values. The given task is solved as follows. The vortex furnace consisting of a combustion chamber with at least one wall-mounted tilted burner, a prism-shaped ash hopper with a slotted mouth formed by the slanted walls of lower combustion chamber region and the bottom airflow device located below the ash hopper mouth. In addition the wall opposite to the bottom airflow device has the curved surface relative to the given device. The bottom airflow device spans along the entire width of the mouth and the above curved wall in its upper region is adjacent to the ash hopper mouth. This wall is built as the imaginary surface being its continuation crosses the opposite slanted wall of ash hopper in its middle region. The bottom airflow nozzle axis goes along the lower region of the curved wall and is directed upwards at the angle between the said axis and curved wall in its lower region equal to 0–45 degrees. Due to the location of the bottom airflow device along the entire width of slotted mouth the operation of such furnace provides the vortex zone formation practically in the entire volume of lower combustion chamber and prevents the possibility of fuel particle drop-off because of the irregular bottom airflow. The given tilt angle of the airflow nozzle provides the most efficient "impact" angle for the fuel and slag particles to minimize energy losses. This provides the most successful furnace operation. The location of the upper curved wall region as described above is determined at first with regard to the erosion danger of wall tube twists in the ash hopper mouth and secondly to the possibility of tearing the bottom airflow off the slanted wall of ash hopper and subsequent transition to the so-called "fountain" regime at which the vortex process aerodynamics deteriorates and heat losses resulted from the unburned fuel abruptly grow. First of all the given design is aimed at shifting all particles that happened to drop into the ash hopper to the lower region of the curved wall. Having lost a portion of their kinetic energy as a result of the impact, these particles roll downwards affected by the upcoming bottom airflow that forces them back into the combustion chamber. The absence of "narrow' regions excludes the collection of coarse slag lumps. It is expedient to form the lower region of the wall equipped with the bottom airflow device tilted to horizon at a given angle. As the angle between the bottom airflow nozzle axis and lower region of the curved wall has a defined number lightly weighted fuel particles are forced by the airflow into the vortex zone and slag particles drop off as a result of their weight. Fuel particles drawn to the curved wall have a different velocity and a different velocity vector. In case the wall tilt angle exceeds 45 degrees some fuel particles with higher velocity slightly lose their velocity on wall impact (a sliding impact occurs) and they can, having overcome the airflow resistance, enter the ash hopper increasing the unburned fuel losses. If the wall tilt angle is below 20 degrees then all fuel particles lose their velocity at this wall and are forced by the bottom airflow into the vortex zone for compete combustion. However at such tilt angle some heavier slag particles may gather and even provoke the filling of the bottom airflow device.

Orientation of the upper curved wall region is chosen on the base of the following. The bottom airflow coming from the ash hopper mouth must pick up fuel particles collected at the slanted wall. Therefore, the earlier the airflow nozzle axis crosses this slanted wall, the better. At the same time it is necessary to exclude the contact of this flow carrying abrasive particles (fuel, ash particles etc) with wall tube twists since these are the most dangerous points from the viewpoint of possible wall tube breakdowns since as wall tubes are twisted during fabrication their upper region become thinner (stretched). It is expedient for the bottom airflow device to have two similar parts symmetric with regard to the vertical axis of combustion chamber.

BRIEF DESCRIPTION OF THE DRAWING

The invention is illustrated by the drawings at which

DESCRIPTION OF PREFERRED EMBODIMENT OF THE INVENTION

Figure 1:
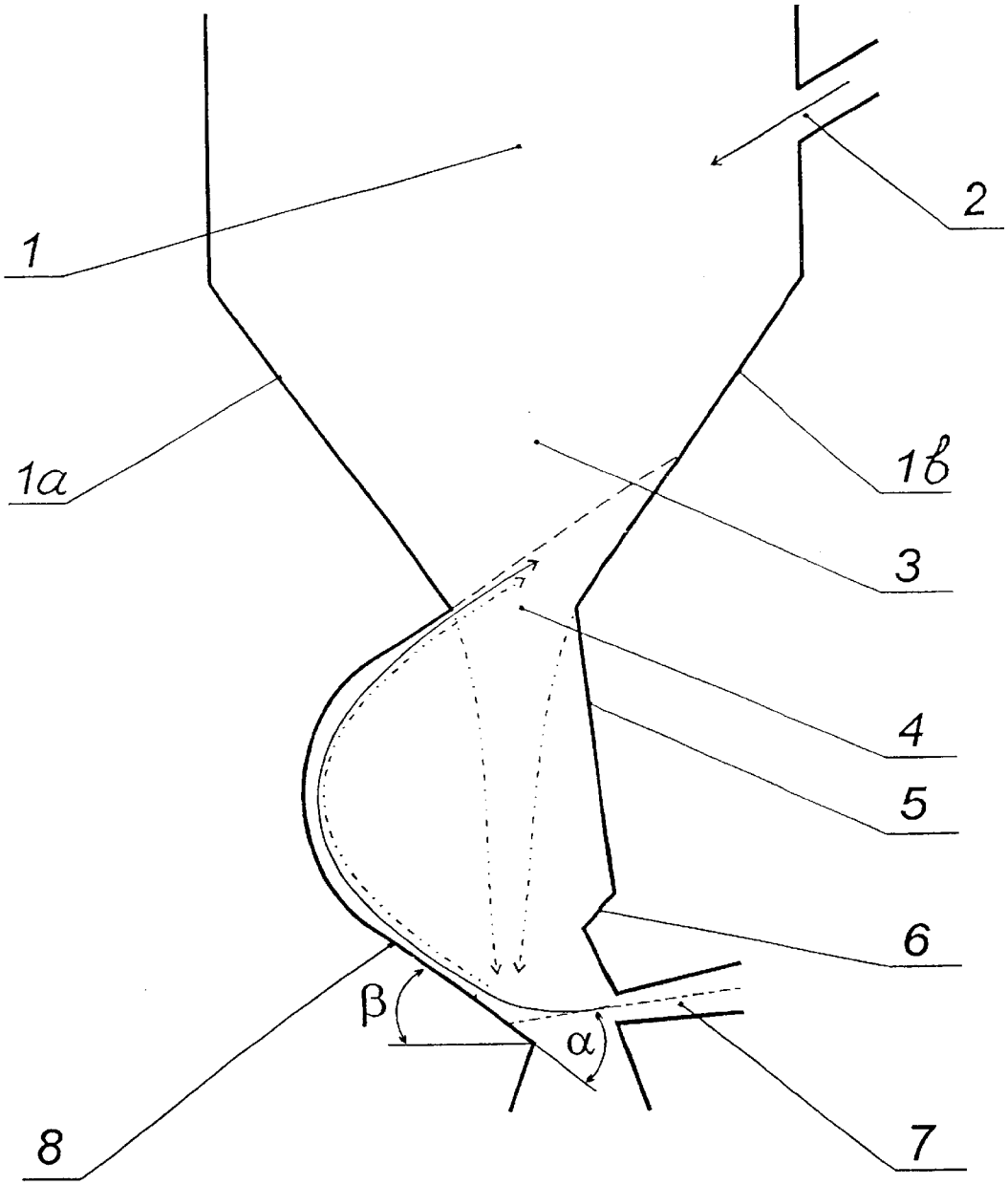
FIG. 1 shows the lower furnace region designed according to the invention in its vertical cross-section.
Figure 2:
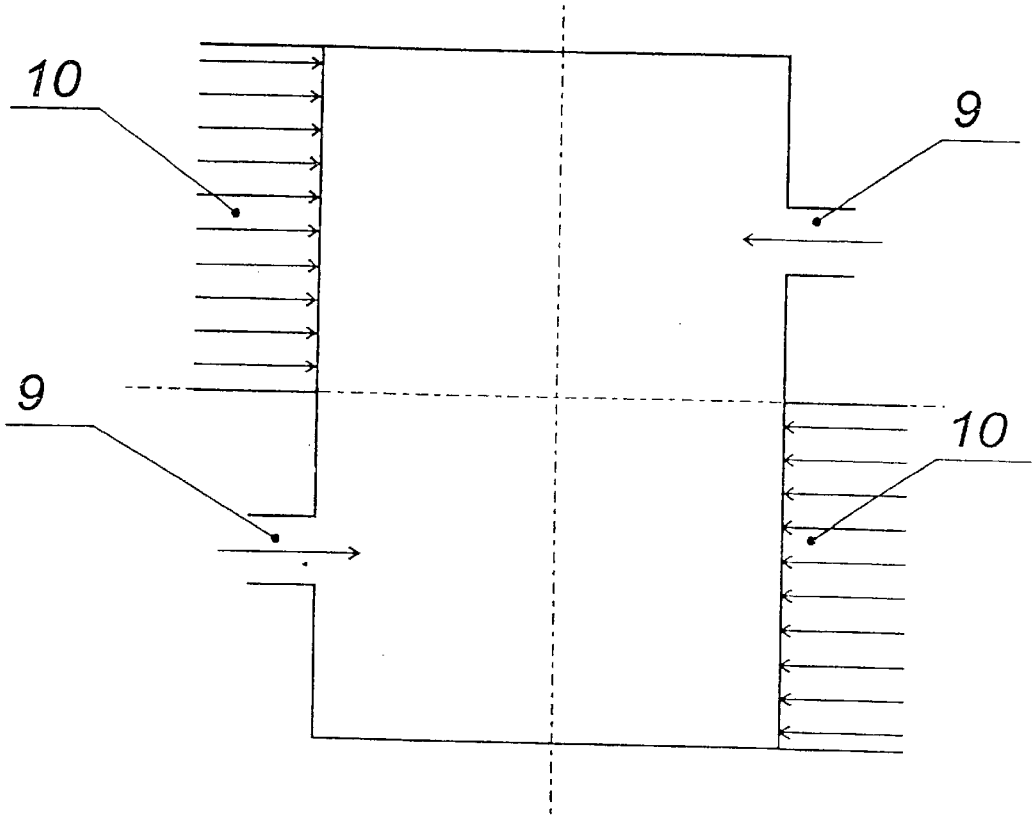
FIG. 2 shows a schematic fuel and bottom airflow feeding for another version of the present design.

As FIG. 1 shows the vortex furnace consists of the combustion chamber 1 equipped with the wall-mounted tilted burner 2. In the lower region the combustion chamber wall are slanted and these walls 1*a* and 1*b* (not shown at the drawing) form the prism-shaped ash hopper 3 with slotted mouth 4. Below the slotted mouth 4 the bottom airflow device 5 is installed along the entire width of ash hopper. Below the lower slanted walls of the combustion chamber, one of the walls 6 of the device 5 is equipped with the airflow nozzle 7 and the opposite wall 8 of the bottom airflow device has a curved shape relative to this nozzle. The axis of nozzle 8 crosses the lower region of curved wall 8. The angle $\alpha$ between this axis and lower region is in range of 0 to 45 degrees. Curved wall 8 in its lower region is tilted to horizon at the angle of 20–45 degrees. Curved wall meets the edge of ash hopper mouth 4 in its upper region. An imaginary plane shown in the drawing with dotted line being the continuation of upper wall region the 8 crosses the opposite slanted wall 1*b* in its middle region. The bottom airflow device may have an axis-symmetric design as schematically shown in FIG. 2. In this case this device consists of two parts similar to the above-mentioned one. These parts are symmetric with regard to the vertical axis of combustion chamber. The first part adjacent to the curved wall has the mounted airflow nozzle. And on the contrary, the second part of the device has the mirrored design relative to the first part. Operation of the furnace designed in accordance with this invention stipulates the air-fuel mixture supply through burner 2 and the bottom air supply through nozzle 7 of the device 5. Small fuel particles burn out in the vicinity of burner and coarser ones drop into the lower region and enter the bottom airflow. On interaction of counter-directed flows of air-fuel mixture and bottom air the vortex zone is formed in the lower region of combustion chamber. Due to repeated circulation large portion of coarse fuel particles burn out in this zone. Since the bottom airflow device 5 is located along the entire width of slotted mouth 4 all fuel particles in lower region enter the bottom airflow and the vortex zone is formed practically in the entire lower region of combustion region what prevents the drop-off of some fuel particles because of non-uniform bottom airflow. However some coarser and more kinetic particles may always be present in air-fuel mixture. These particles tend to overcome the air-flow resistance and drop down through slotted mouth into the bottom airflow device. Besides, as was shown above there is a possibility of fuel particle collection along wall tubes. Reaching a large amount, these lumps of particles fall into the bottom airflow device. There is also a possibility of a drop-off provided the thermal insulation is not airtight. All these particles passing slotted mouth are deposited at the lower region of curved wall 8, lose their velocities and slowly climb downward. As mentioned above, at the given tilt angle of 20–45 degrees between curved wall and horizon the climb-down velocity of fuel and slag particles is such that so fuel particles tend to dry out before reaching the wall edge. After that they enter the bottom airflow and are forced back into the vortex region whereas slag particles slowly climb down into ash hopper without melting or reaching a critical mass that might provoke the ash hopper blockage. Due to the ratio between axis angles of the bottom airflow nozzle and lower wall 8 the most effective interaction of bottom airflow and fuel particles is formed near the wall 8. Besides, at such angle ratio the bottom airflow passes along the wall 8 and comes out of slotted mouth 4 at the angle allowing this airflow to cross the slanted wall 1*b* in its middle region. As a result of this the erosion danger of wall tube twists is diminished. That occurs provided the bottom airflow mixed with fuel particles meets the upper region of ash hopper. In case this flow meets the lower region of ash hopper there appears a danger of tearing the bottom airflow off slanted wall and, as was mentioned above, transition to a "fountain" regime.

In case the bottom airflow device consists of two similar axis-symmetric parts relative to the vertical axis of combustion chamber its operation occurs in a similar manner. FIG. 2 schematically shows the direction of air-fuel mixture supply through burners 9 and bottom air supply through nozzles 10. This scheme of the invention allows to achieve more effective combustion since aside from horizontal vortex a vertical vortex is formed in the lower combustion chamber region.

Thus the proposed invention allows to improve fuel combustion at simultaneous decrease of ash hopper blockage and also to raise economic numbers of furnace.

Industrial Application

The invention may be implemented both for building new furnaces and modernizing older ones. This invention may successfully be implemented for pulverized coal furnaces.

What is claimed is:

1. A furnace comprising:

a combustion chamber;

a downwardly tilted burner arranged on a wall of the combustion chamber, the burner injecting an air-fuel mixture into the combustion chamber;

an ash hopper beneath the combustion chamber and connected thereto, the ash hopper having a slotted mouth; and, an airflow device beneath the ash hopper and connected with the ash hopper via the slotted mouth, the airflow device having an air nozzle for injecting an air flow, and a curved surface arranged opposite the air nozzle, the air nozzle cooperating with the curved surface to return at least a portion of the fuel which enters the airflow device to the ash hopper, wherein the curved surface includes a lower portion arranged at an angle relative to the nozzle axis, and wherein the angle between the lower portion of the curved surface and the nozzle axis is between 0 degrees and 45 degrees inclusive.

2. The furnace as set forth in claim 1, wherein the angle between the lower portion of the curved surface and the horizontal is between 20 degrees and 45 degrees inclusive.

3. The furnace as set forth in claim 1, wherein the curved surface includes an upper portion arranged to direct the airflow toward a middle portion of a wall of the ash hopper.

4. The furnace as set forth in claim 1, wherein the curved surface includes an upper portion arranged to counter-direct the air flow relative to the injected air-fuel mixture flow, the mixing of the air-fuel mixture flow and the counter-directed flow producing a vortex zone in at least one of the ash hopper and the combustion chamber.

5. The furnace as set forth in claim 4, wherein the curved surface includes a wall having a concave shape arranged opposite the air nozzle.

6. The furnace as set forth in claim 1, wherein the ash hopper includes a plurality of slanted sides that slant inwardly toward one another to form the slotted mouth.

7. The furnace as set forth in claim 1, wherein the airflow device is co-extensive with the slotted mouth of the ash hopper.

8. The furnace as set forth in claim 7, wherein the re-directed air flow interacts with the injected air-fuel mixture flow to produce a vortex region that is co-extensive with the length of the slotted mouth of the ash hopper.

9. A furnace comprising:

a combustion chamber;

a downwardly tilted burner arranged on a wall of the combustion chamber which injects an air-fuel mixture into the combustion chamber;

an ash hopper arranged beneath the combustion chamber and connected thereto, the ash hopper having a slotted mouth; and, an airflow device arranged beneath the ash hopper and connected with the ash hopper via the slotted mouth, the airflow device having an air nozzle for injecting an air flow, and a curved surface arranged opposite the air nozzle, the air nozzle cooperating with the curved surface to return at least a portion of the fuel which enters the airflow device to the ash hopper, wherein the ash hopper includes a plurality of slanted sides that slant inwardly toward one another to form the slotted mouth, and wherein the portion of the fuel returned by the airflow device is returned along a trajectory defined by an imaginary surface continuation extending in planar fashion from an upper portion of the curved surface and intersecting one of the plurality of slanted sides in its middle region.

10. The furnace as set forth in claim 9, wherein the airflow device is co-extensive with the slotted mouth of the ash hopper.

11. The furnace as set forth in claim 10, wherein a re-directed air flow interacts with the injected air-fuel mixture flow to produce a vortex region that is co-extensive with the length of the slotted mouth of the ash hopper.

12. The furnace as set forth in claim 9, wherein an angle between the lower portion of the curved surface and the horizontal is between 20 degrees and 45 degrees inclusive.

13. The furnace as set forth in claim 9, wherein the curved surface includes an upper portion arranged to direct the airflow toward a middle portion of a wall of the ash hopper.

14. The furnace as set forth in claim 9, wherein the curved surface includes an upper portion arranged to counter-direct the air flow relative to an injected air-fuel mixture flow, mixing of the air-fuel mixture flow and the counter-directed flow producing a vortex zone in at least one of the ash hopper and the combustion chamber.

15. The furnace as set forth in claim 9, wherein the curved surface includes a wall having a concave shape arranged opposite the air nozzle.

16. A vortex furnace comprising:

a combustion chamber with at least one wall-mounted burner tilted downwardly for feeding an air-fuel mixture;

a prism-shaped ash hopper with a slotted mouth defined by slopes of walls in a lower region of the combustion chamber;

a bottom airflow device located below the ash hopper mouth and coextensive in width with the ash hopper; and a bottom airflow nozzle located in a lower region of the bottom airflow device and arranged facing a concave wall of the airflow device, said wall having a concave form relative to said airflow nozzle;

wherein said concave wall has an upper region that extends and meets the ash hopper mouth, the upper region defining an imaginary plane following a continuation of said concave wall and crossing an oppositely sloped wall of the ash hopper in its middle region; and, wherein an axis of the bottom airflow nozzle intersects a lower region of said concave wall and forms an angle between said axis and the lower region of said concave wall, said angle being between 0 degrees and 45 degrees inclusive.

17. The vortex furnace as set forth in claim 16, wherein:

the lower region of said concave wall is tilted relative to the horizontal at an angle of between 20 degrees and 45 degrees.

18. The vortex furnace as set forth in claim 16, wherein:

the bottom airflow device includes two similar parts which are symmetrical relative to a vertical axis of the combustion chamber.

19. A furnace comprising:

a combustion chamber;

a downwardly tilted burner arranged on a wall of the combustion chamber for injecting an air-fuel mixture into the combustion chamber;

an ash hopper arranged beneath the combustion chamber and connected thereto, the ash hopper having a slotted mouth; and, an airflow device arranged beneath the ash hopper and connected with the ash hopper via the slotted mouth, the airflow device having an air nozzle for injecting an air flow, and a curved surface arranged opposite the air nozzle, the air nozzle cooperating with the curved surface to return at least a portion of the fuel which enters the airflow device to the ash hopper, wherein the curved surface includes an upper portion arranged to counter-direct the air flow relative to the injected air-fuel mixture flow, the mixing of the air-fuel mixture flow and the counter-directed flow producing a vortex zone in at least one of the ash hopper and the combustion chamber, wherein the curved surface includes a wall having a concave shape arranged opposite the air nozzle, and wherein the concave shape includes a lower portion arranged to receive fuel particles that drop down from the vortex region into the airflow device.

20. The furnace as set forth in claim 19, wherein the airflow device is co-extensive with the slotted mouth of the ash hopper.

21. The furnace as set forth in claim 20, wherein a re-directed air flow interacts with the injected air-fuel mixture flow to produce a vortex region that is co-extensive with the length of the slotted mouth of the ash hopper.

22. The furnace as set forth in claim 19, wherein an angle between the lower portion of the curved surface and the horizontal is between 20 degrees and 45 degrees inclusive.

23. The furnace as set forth in claim 19, wherein the curved surface includes an upper portion arranged to direct the airflow toward a middle portion of a wall of the ash hopper.

24. The furnace as set forth in claim 19, wherein the ash hopper includes a plurality of slanted sides that slant inwardly toward one another to form the slotted mouth.

* * * * *